United States Patent [19]

Weinberger

[11] Patent Number: 4,584,801

[45] Date of Patent: Apr. 29, 1986

[54] TEMPORARY BUILDING STRUCTURE

[76] Inventor: Edward A. Weinberger, 86-21 120th St., Richmond Hill, N.Y. 11418

[21] Appl. No.: 772,645

[22] Filed: Sep. 5, 1985

[51] Int. Cl.[4] ..... E04B 1/346

[52] U.S. Cl. ..... 52/64; 52/261; 52/270; 52/282; 52/280; 52/299; 52/741; 403/171; 403/172

[58] Field of Search ..... 52/64, 227, 261, 270, 52/282, 780, 781, 280, 299, 285, 648, 741; 403/7, 171, 172, 176

[56] References Cited

U.S. PATENT DOCUMENTS

| | | | |
|---|---|---|---|
| 2,470,403 | 5/1949 | Klomparens | 403/172 |
| 3,538,662 | 11/1970 | Van Tuyl | 52/270 X |
| 3,624,974 | 6/1969 | Addington | 52/64 |
| 3,681,888 | 8/1972 | Kim | 52/280 X |
| 4,067,165 | 1/1978 | Timmons | 52/282 X |
| 4,079,995 | 3/1978 | Beckley | 403/171 X |
| 4,282,693 | 8/1981 | Merklinger | 52/282 |
| 4,485,598 | 12/1984 | Guadiani | 52/299 X |

*Primary Examiner*—Carl D. Friedman
*Assistant Examiner*—Creighton Smith

[57] ABSTRACT

A kit of contructural elements permitting the quick assembly and knockdown of a temporary building structure. The kit includes a plurality of base beams which form the base frame of the structure. The two ends of each base beam are opposingly stepped whereby adjacent base beams can form an overlap joint at each base corner. Aligned apertures are formed through the overlap joint. Beneath each step at the end of a beam there is provided an undercut, whereby at a corner the undercuts merge to provide a notched corner. An upright stud with a depending bolt is inserted into the aligned joint and projects into the notch whereby a nut can fit onto the bolt without lifting the frame. The single nut is used to interconnect a vertical stud and two adjacent horizontal beams. Upper beams are utilized at the roof level and also include stepped corners. Wall panels can be inserted into grooves formed in the various beams and studs.

21 Claims, 13 Drawing Figures

TEMPORARY BUILDING STRUCTURE

BACKGROUND OF THE INVENTION

This invention relates to a temporary building structure, and more particularly to a building structure which permits quick assembly and knockdown.

Temporary building structures are often erected for various uses. For example, in the Jewish religion, fulfilling the requirement of commemorating the exodus from Egypt, a temporary building structure or "SUCCAH" is constructed. This structure is often referred to as a tabernacle, booth, or hut. It is erected for about a week or two and is then knocked down and stored until the next year when again it is erected. During its assembly, it must be sturdy enough to permit usage for eating, entertaining, and general living. However, it must at the same time permit easy assembly and knockdown without excessive cost, manpower, or time.

Additional types of temporary building structure are found in backyard huts or enclosed porches which are put up during the summer months and taken down for the winter. Similarly, temporary structures are utilized in farming communities where such huts are located during the harvest season for temporary storage of equipment, or even for a temporary residence of some of the harvest employees.

In each case, the critical need is for ease of assembly and the minimal amount of time and effort required for putting up and taking down the structure. At the same time, it should be constructed so that it permits storage without excessive amount of room.

Various types of temporary structures have heretofore been suggested for such purposes, and especially for the purpose of the "succah". By way of example, plumbing pipes have been utilized with fittings to form a frame which is then wrapped around with a canvas. However, the use of the canvas is not sturdy, and the weight of the pipes is quite heavy and requires more than one person to assemble. Additionally, the interconnecting fittings may be easy to manipulate, but it requires lifting of the entire frame in order to get access to these fittings for assembly and knockdown.

Other approaches have been suggested utilizing wood, plastic or aluminum panels, and the like. In each case, however, the problem is to initially erect the frame which must be sturdy enough to support the panels and be sufficiently strong to withstand the environmental conditions such as wind, storm, etc. As a result, the frame itself becomes quite heavy and needs more than one person to erect. In such assembly, frequently the frame itself must be fully lifted in order to get access to the proper nuts and bolts used to connect the parts of the frame.

SUMMARY OF THE INVENTION

Accordingly, it is an object of the present invention to provide a temporary building structure which can be easily and quickly assembled and knocked down.

Another object of the present invention is to provide a kit of constructional elements which permits quick assembly and knockdown of a temporary building structure.

Still a further object of the present invention is to provide a method of assembling a temporary building structure which reduces the time and effort involved in such assembly.

A further object of the present invention is to provide a temporary building structure which can be easily assembled without the necessity of lifting the parts of the building structure once assembled.

Yet a further object of the present invention is to provide constructional elements which can interfit to erect a temporary building structure with the assembly permitting interconnection of three orthogonal beams using a single coupling.

Still a further object of the present invention is to provide a kit of constructional elements which can be assembled to form a frame of a temporary building structure, with the parts interconnected without the need for lifting the assembled parts to gain access to the coupling connections.

Briefly, in accordance with the present invention, there is provided a kit of constructional elements which permit the quick assembly and knockdown of a temporary building structure. The kit includes a plurality of base beams which are assembled to form a peripheral base frame. The two ends of each of the base beams are opposingly stepped. In this manner, when adjacent base beams are interconnected at a corner, the opposing steps of the adjacent beams can form an overlap joint. An aligned aperture is formed in the overlapped stepped joint. The distal end of each of the base beams is undercut beneath the step. In this manner, as the adjacent beam ends interfit to form an overlap joint, the undercuts merge to form a notched corner beneath the overlap joint.

A plurality of upright studs are provided. Each of the studs has axially projecting pins from its bottom and top. The stud is placed at a corner of the base beam frame with one of the pins depending through the aligned apertures at the corner. A suitable clamping device is clamped onto the depending pin. In this manner, through the use of a single clamping device, three members can be interconnected. Specifically, a vertical stud, and a pair of adjacent base beams are all assembled by means of a single clamping device.

The clamping device is connected in the corner notched portion. As a result, the clamping device can be placed on the pin, as well as removed from the pin, without the need of lifting the base structure. This permits easy assembly and knockdown without the need of additional help in lifting or raising the structure.

Additional vertical studs can be placed along the structure to provide additional support. Undercut notches are located at each position of the stud so that the stud can be interconnected by means of a similar pin and clamping arrangement at each of the notched sections, again without lifting the building structure.

The invention also contemplates a building structure having the specific structural arrangement with beams having opposing steps at their ends, with undercut notches therebeneath. The invention further contemplates a method of assembling a temporary building structure utilizing the aforesaid type of beams.

The aforementioned objects, features and advantages of the invention will, in part, be pointed out with particularity and will, in part, become obvious from the following more detailed description of the invention, taken in conjunction with the accompanying drawings, which form an integral part thereof.

BRIEF DESCRIPTION OF THE DRAWINGS

In the drawings.

In the various figures of the drawing, like reference characters designate like parts.

DESCRIPTION OF THE PREFERRED EMBODIMENT

Figure 1:
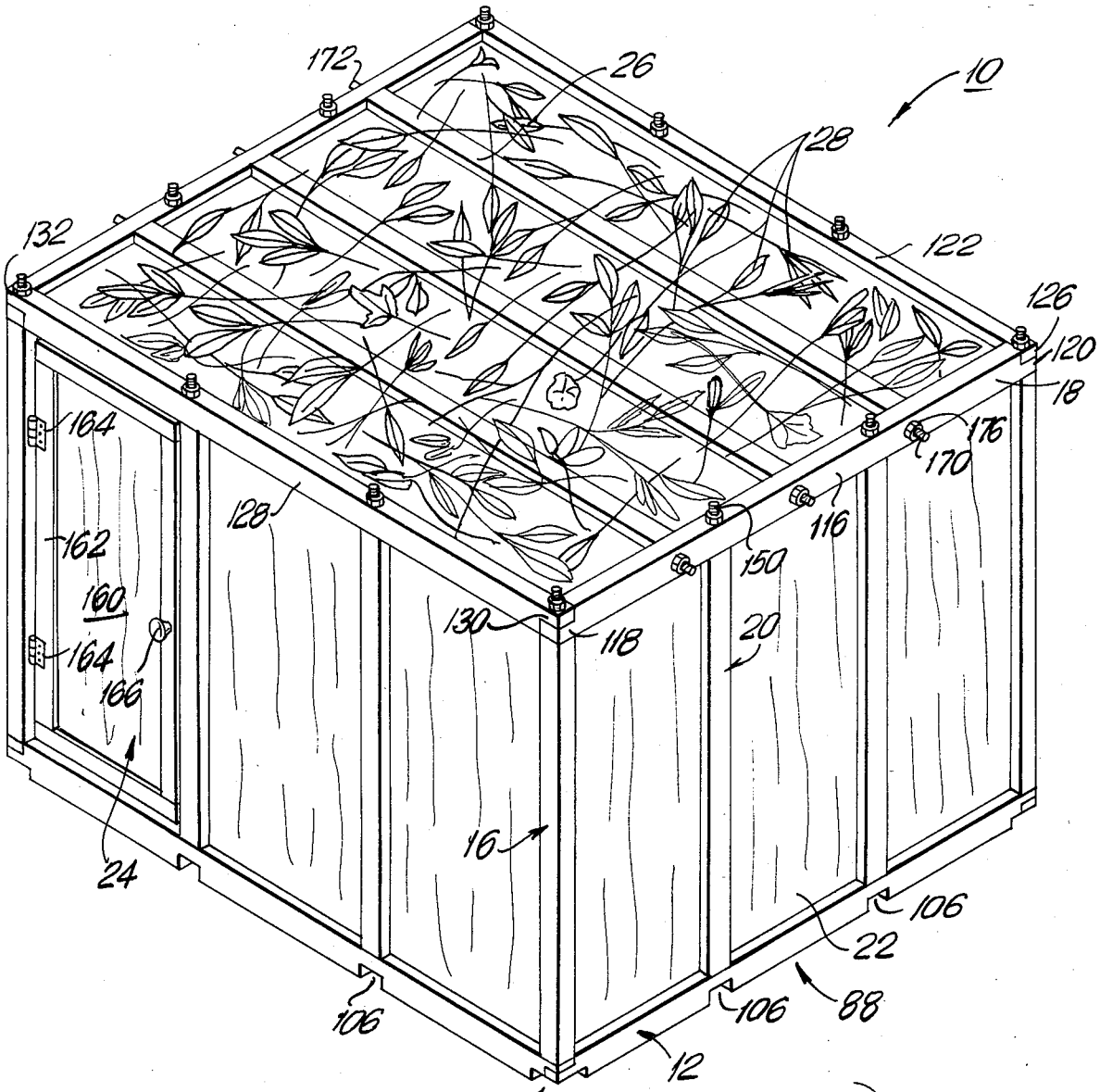
FIG. 1 is a perspective view of the assembled temporary building structure in accordance with the present invention.

Referring now to FIG. 1, the temporary building structure of the present invention is shown generally at 10 and is specifically shown as being for use as a "succah" serving as a temporary hut or tabernacle required for the Jewish holiday of the Feast of Tabernacles.

The building structure includes a plurality of base beams 12 which are interfitted together to form corner joints 14. A plurality of upright studs 16 extend between each of the base beams 12 and the upper beams 18. In addition to the corner studs 16 there are also provided interspaced studs 20 which also extend between the base and upper beams. Side wall panels 22 complete the structure around its periphery. A door 24 can be inserted in place of one of the panels to provide access to the interior of the structure.

Across the top there are provided a plurality of tie beams 26 spanning the roof and supporting grass, twigs, branches and the like 28. In accordance with the religious requirements for the construction of the "succah", the roof must not be solid but be formed of natural growing material which has been cut and placed upon the roof to show the temporary nature of the structure. In place of the twigs and branches, bamboo sticks, firring strips, and other types of natural growing, temporarily placed material can be used.

Figure 2:
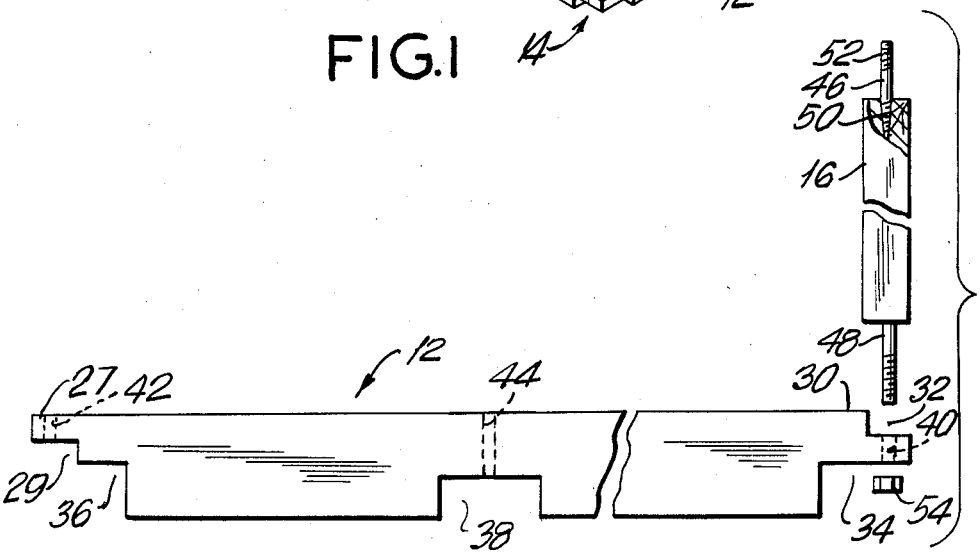
FIG. 2 is an exploded view of the assembly of an upright stud to a base beam.

As shown in FIG. 2, each of the base beams 12 is formed of an elongated block of wood, typically a 2" by 4". Opposing ends are alternately stepped. Specifically, the end 27 includes an upward step 29 while the end 30 includes a downward step 32. Beneath each of the steps 32, 29 there is provided an undercut portion 34, 36. It should be noted, that the undercut portion extends deeper into the longitudinal length of the beam 12 than does the steps. Along the length of the beam 12 there is also provided at least one additional undercut notch 38. An aperture is formed in each of the notched sections. Specifically, extending through the step 32 there is provided an aperture 40. Through the step 29 there is provided an aperture 42, and through the center notched section 38 there is provided an aperture 44.

The upright stud 16 is shown as also being a beam, typically a 2" by 3". Axially projecting from either end of the stud 16 is a threaded bolt 46, 48. The bolts are such as to be threaded on either end with a wood thread 50 at one end so that it can be embedded into the stud, and a machine threaded end 52 at the opposing end on which a nut 54 can clamp.

Figure 3:
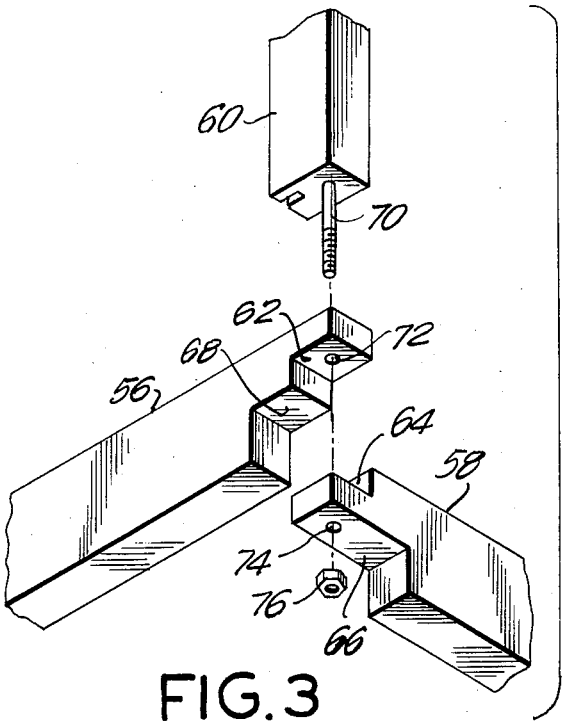
FIG. 3 is an exploded perspective view of a base corner interconnecting adjacent base beams and an upright stud.
Figure 4:
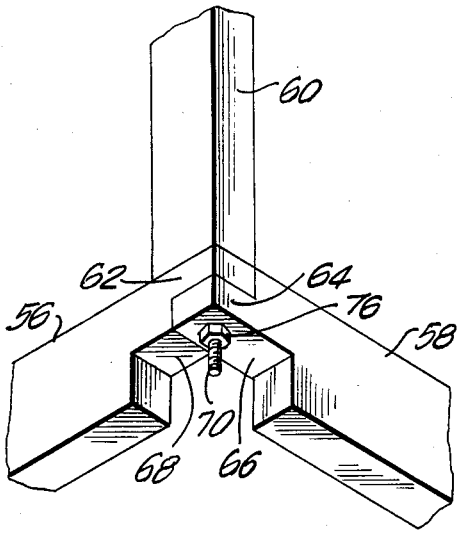
FIG. 4 is an assembled view of the parts shown in FIG. 3.

As shown in FIGS. 3 and 4, each of the base corners can be assembled so as to utilize a single nut to clamp together three structural elements. Specifically, adjacent base beams 56, 58 and a corner upright stud 60 are shown as being interconnected at a single corner. The base beam 56 includes an upwardly stepped end 62 while the base beam 58 has a downward step 64 at its end. A notched section 66 is formed under the step 64 and a notched section 68 is formed under the step 62. The upright stud 60 includes the downwardly projecting bolt 70. Aligned apertures 72, 74 are formed in each of the steps 62, 64.

When assembled, the steps 62, 64 interfit to provide an overlap joint. The bolt 70 runs through the aligned apertures 72, 74 to project downwardly into the undercut. A corner undercut is formed as the two undercut sections 66, 68 merge to form a single undercut corner. By means of a single nut 76, the three structural elements can be easily interconnected and are securely held together.

It should be appreciated that because the steps are each perpendicular to each other, the side walls of the steps form a perfect perpendicular arrangement whereby the two adjacent horizontal beams are locked to each other in orthogonal arrangement and cannot pivot with respect to each other. Similarly, because of the perpendicular arrangement two horizontal beams could be accurately aligned end to end linearly.

As can best be seen in FIGS. 1 and 4, because of the undercut corner notch, the nut can be placed onto the depending bolt without having to lift the base frame of the building structure. This permits the assembly and knock down of the structure without having to have additional help in lifting. The members can be assembled on the ground and once assembled can remain there without any lifting to connect the parts.

Figure 5:
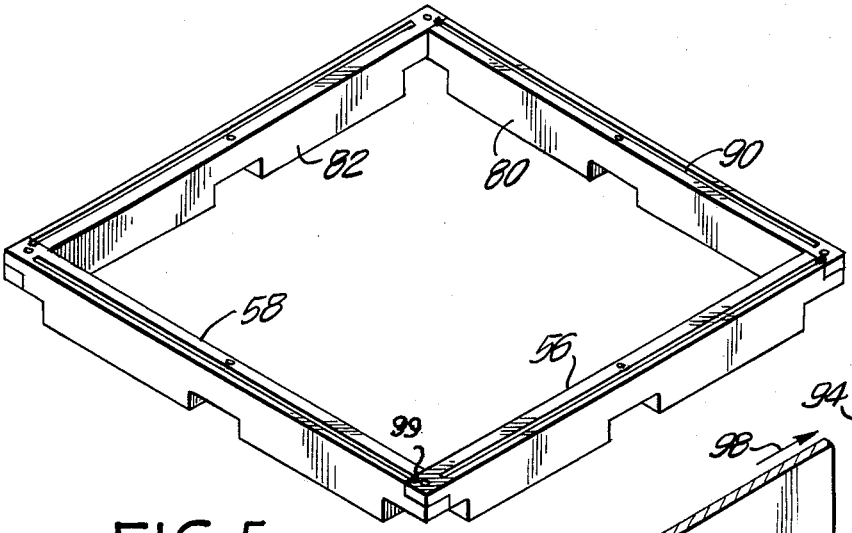
FIG. 5 is a perspective view of the base beams interfitted together.

Assembly of the entire building structure will now be described. Initially, four base beams are interconnected, as shown at FIG. 5. Specifically, the beams 56, 58, 80 and 82 are interfitted so that the ends of the beams overlap each other and form the overlap joints at each corner. Since the ends of each beam are opposingly stepped, all beams are identical and can be used interchangeably at each side. So long as one end overlaps the other a suitable corner joint is formed.

With the base frame now laid on the ground, assembly of one wall is begun. Typically, the wall that is assembled first is the wall to the right of the wall containing the door. More particularly, as shown in FIG. 1, the left side wall includes the door 24. Accordingly, the right side wall, identified as wall 88 is begun first.

The wall construction begins by inserting the left most upright stud. The stud is inserted into the overlap joint as shown in FIG. 3 and locked in place as shown in FIG. 4.

Figure 6:
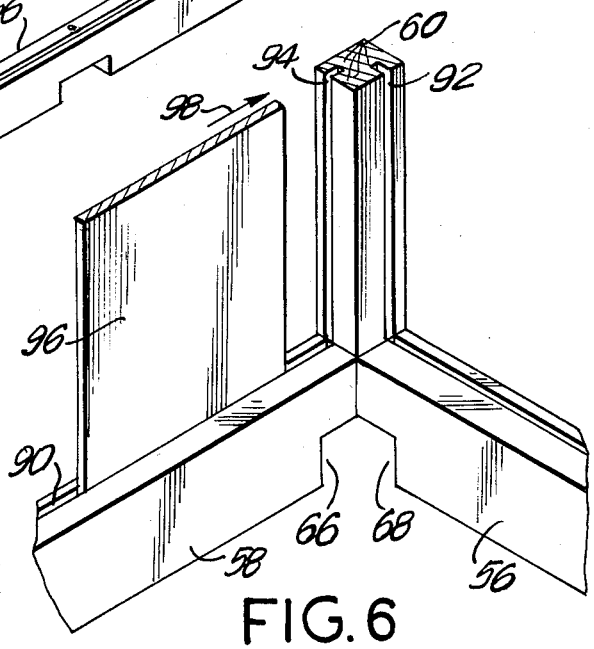
FIG. 6 is a perspective view, taken from the inside, showing the assembly of a wall panel onto a base corner of the structure.

As shown in FIGS. 5 and 6, there are channels provided in the various members. Along the base beams, there is provided a channel 90 projecting downwardly from the upper face thereof. Likewise, channels 92, 94 arrangement could be utilized to form any other temporary structure, including one on which a roof would be included. The roof could be a solid roof which would lie upon the tie beams. Alternately, roof panels could be placed upon the tie beams in sections. One of the panels could also include an integral window whereby a desired window would be provided within the temporary structure. Also, instead of nuts and bolts, other types of fasteners could be used.

There has been disclosed heretofore the best embodiment of the invention presently contemplated. However, it is to be understood that various changes and modifications may be made thereto without departing from the spirit of the invention.

What is claimed is:

1. A kit of constructional elements permitting quick assembly and knock down of a temporary building structure, comprising a plurality of base beams forming a peripheral base frame, the two ends of each base beam being opposingly stepped whereby the stepped ends of adjacent base beams can form an overlap joint at each base corner, aligned apertures formed through the overlap stepped joint, the distal end of each base beam being undercut beneath the step whereby the undercut ends of adjacent beams merge to form a notched corner beneath the overlap joints, a plurality of upright studs having an axially depending pin for projecting through the aligned apertures and into the notched corner, and a retaining member coupling onto the depending pin in the notched corner whereby a pair of adjacent base beams and an upright stud can be secured together by a single retaining member which can be attached and released without lifting of the base frame.

2. A kit as in claim 1, and further comprising a plurality of roof beams forming a peripheral upper frame, the two ends of each roof beam being stepped whereby the stepped ends of adjacent roof beams can form an overlap joint at each upper corner, aligned apertures formed through the overlap joints at the upper corners, said upright studs including an upstanding pin for extending through the aligned apertures at each upper corner, and wherein said retaining member can couple onto the extending pin whereby a pair of adjacent roof beams and an upright stud can be secured together by a single retaining member.

3. A kit as in claim 2, wherein one roof beam has both its ends downwardly stepped, one roof beam has both its ends upwardly stepped, and all other roof beams have its two ends opposingly stepped.

4. A kit as in claim 2, and further comprising wall panels, and coupling means for removably coupling the wall panels between said base beams, said roof beams, and said upright studs.

5. A kit as in claim 4, and comprising channels formed into the facing edges of said base beams, said roof beams, and said upright studs, said wall panel being slideably received in said channels.

6. A kit as in claim 5, wherein said channels are formed closer to the exterior side of said beams than their interior side to provide uniform alignment to the building structure.

7. A kit as in claim 5, wherein the channels formed into said roof beams have outwardly flaired mouths to facilitate placement of the roof beam channels onto the wall panels.

8. A kit as in claim 2, wherein said base beams further comprise at least one undercut notch spaced along the length of the base beam, an aperture through the base beam in communication with said undercut notch for receiving the depending pin of an upright stud, said retaining means coupling onto the depending pin in said undercut notch without the lifting of the base frame to retain an upright stud spaced along the base beam.

9. A kit as in claim 8, wherein said roof beams further comprise at least one vertical aperture therethrough aligned with the spaced aperture in the base beam, to receive an upstanding pin of the spaced along upright stud.

10. A kit as in claim 2, and further comprising a plurality of tie beams having axially projecting pins at opposing ends thereof, and a plurality of laterally extending apertures spaced along said roof beams for receiving the pins of said tie beams, said retaining means securing said tie beams to said roof.

11. A kit as in claim 1, wherein the undercuts are longer than the steps.

12. A kit as in claim 2, wherein said pins are threaded bolts having one embedded end and an opposing projecting end, and wherein said retaining means are on nuts threaded onto the projecting ends of the bolts.

13. A quick assembly building structure comprising a base frame, an upper frame, a plurality of interconnecting upright studs, and wall panels, each corner of the base frame and upper frame having an overlap joint of the stepped ends of adjacent beam members, each stud including axially projecting pins at both ends thereof, an aligned aperture formed through each corner of the base frame and the upper frame for receiving an axially projecting pin, clamping means for retaining a pin in an aligned aperture, whereby a single clamping means can secure together a pair of adjacent beams and an upright stud, an undercut corner notch formed under each corner of the base frame for manipulation of the clamping means without lifting of the structure, and means for connecting the wall panels to the frame members.

14. A quick assembly building structure as in claim 13, and comprising a plurality of undercut notches spaced along said base frame, an aperture formed through the base frame and onto each of said undercut notches, said apertures receiving an axially projecting pin of an upright stud for spacing a plurality of studs around the periphery of the structure, and a clamping means securing the pin in the aperture without the lifting of the structure.

15. A quick assembly building structure as in claim 13, wherein said base frame comprises interconnected base beams and said upper frame comprises interconnected roof beams, the two ends of each base beam being opposingly stepped, the two ends of one roof beam having both its ends upwardly stepped, the two ends of another roof beam having both its ends downwardly stepped, and all other roof beams having their two ends opposingly stepped.

16. A quick assembly building structure as in claim 13, wherein said means for connecting the wall panels comprise channels formed into the inwardly directed faces of said base and upper frames and on opposite sides of said studs, said channels being uniformly offset toward one edge in order to achieve alignment in assembly.

17. A construction method for quick assembly of a temporary building structure, comprising the steps of;

(a) placing four base beams into a rectangular base frame, the ends of each base beam being opposingly stepped with an undercut notch formed beneath each stepped end, the beams being placed to form are provided in the upright 60. With the vertical stud assembled to the adjacent base beams, as shown in FIG. 6, a first wall panel 96 can be slid into the groove 90 in the base beam and fitted into the vertical groove 94 in the upright stud as shown by the arrow 98. A slight channel would also be made in the base beam having the upper step as shown at 99 in FIG. 5, in a position beneath the channel 92 of the stud.

Figure 7:
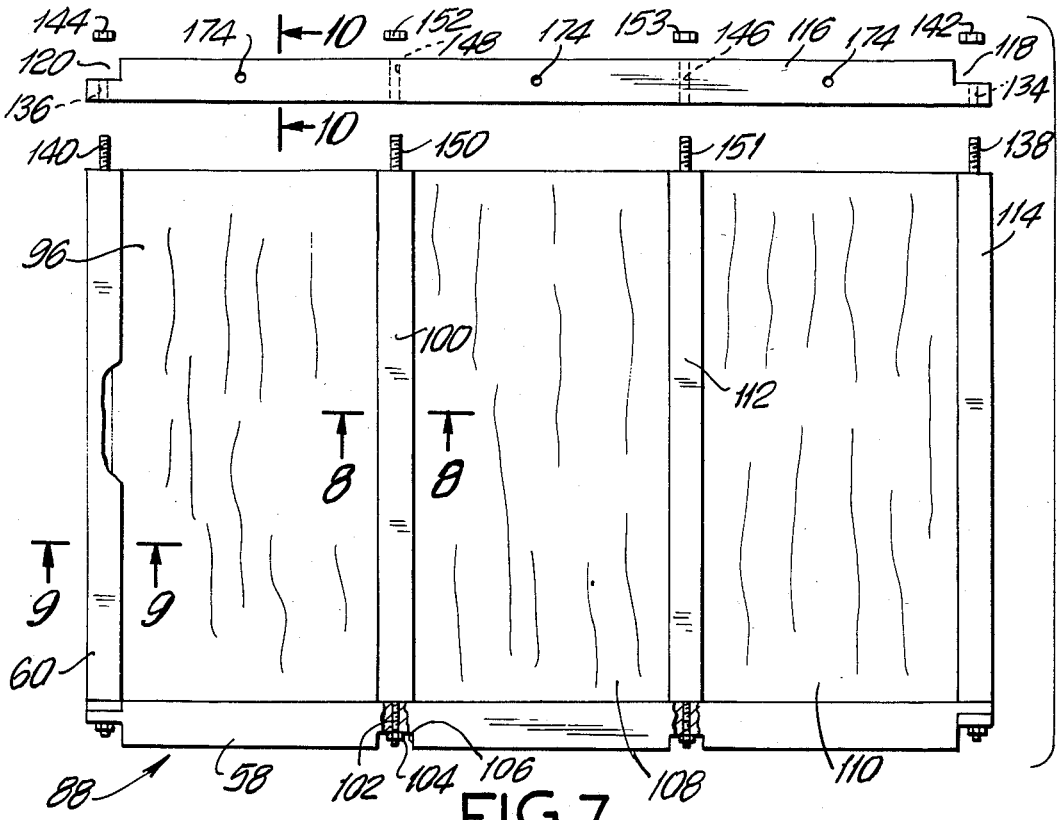
FIG. 7 is an elevational exploded view of a side wall with the upper beam ready for placement onto the wall.
Figure 8:
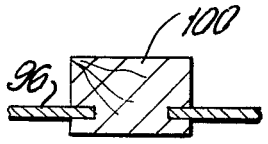
FIGS. 8, 9, and 10 respectively show cross sectional views taken along lines 8—8, 9—9, and 10—10 of FIG. 7, and showing the channels formed in the various members.
Figure 9:
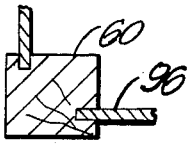

As shown in FIG. 7, after the wall panel 96 is inserted, an additional upright stud 100 can be placed on the beam 58. An appropriate side channel is provided in the stud 100 so as to receive the wall panel 96 therein. The downwardly projecting bolt 102 from the stud 100 fits into the receiving aperture provided in the base beam 58 and a nut 104 can be connected onto the bolt to secure the upright in place. Again, because of the presence of the undercut notch 106 the nut can be secured onto the bolt without having to lift any part of the structure.

Additional panels 108, 110 can be added along the base beam 58 with an additional upright stud 112 spaced along the beam. The number of panels and upright studs will depend upon the length of the base beam. Therefore, the bigger the structure the more panels and interspersed upright studs would be provided along the base beam. At the end of all the wall panels, another corner stud 114 is interconnected in a manner similar to that shown in FIGS. 3 and 4.

Figure 11A:
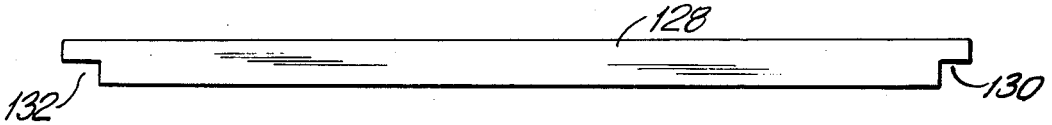
FIGS. 11*a*, 11*b*, and 11*c* show elevational views of the various types of upper beams utilized in the construction of the temporary building structure of the present invention.
Figure 11B:
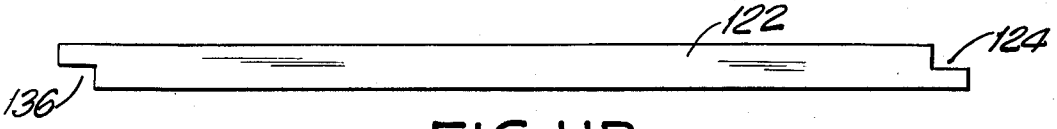
Figure 11C:
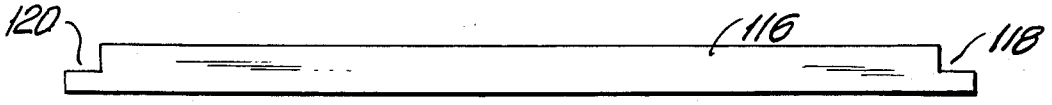

After the wall 88 is completed, as shown in FIG. 7, the upper beam 116 can be placed onto the wall. The upper beam can again be a 2" by 3" with its opposing ends stepped. For convenience, the upper beams are made slightly different than the lower beams. While the lower base beams are all identical to each other, and all have their ends opposingly stepped as shown in FIG. 2, there are three types of upper beams that are provided. Specifically, as shown in FIGS. 11*a*, 11*b*, and 11*c* the ends of the upper beams are formed differently. 11*c* shows the beam 116 which has at its opposing ends a pair of downward steps 118, 120. This is the beam that would be used on the first constructed wall. The beam 122 shown in FIG. 11*b* is similar to that of the base beams in that the two ends are oppositely stepped. Specifically, there is a downward step 124 shown at the right side and an upward step 126 shown at the left side. FIG. 11*a* shows a beam 128 which would be used as the last beam. This has a pair of upward steps 130, 132 at both of its ends.

Accordingly, after the first wall 88 is completed as shown in FIG. 7, the beam 116 is provided which has the opposing downward steps 118, 120 at both its ends. It should be noted, that each of these steps likewise include apertures 134, 136 therethrough which can receive the upwardly projecting bolts 138, 140 from the corner studs 60 and 114. After all of the walls are completed, the nuts 142, 144 will be placed to clamp together these parts.

There are also provided apertures 146, 148 which are aligned with the bolts 150, 151 at each of the intermediate upright studs 100, 112. These bolts pass through the apertures and are locked in place by means of the nuts 152, 153.

Figure 10:
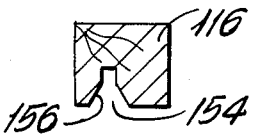

As best shown in FIG. 10, the channel 154 provided in the upper beam 116 includes a flaired mouth portion 156 to facilitate lowering this beam on top of the already placed wall panels.

Referring back to FIG. 1, it can be appreciated that with the wall 88 being constructed first, the upper beam 116 is placed onto the wall. The upper beam has both of its ends downwardly stepped. The next adjacent wall to be constructed will be in a counter clockwise direction from the wall 88. After that wall is completed, the upper beam 122 can be placed on the wall. The upper beam 122 has its end available to sit directly on the downwardly stepped end 120 of the upper beam 116 so that the upper beam 116 need not be removed but the next adjacent upper beam can easily sit right on it. These two upper beams 116, 122 can then be locked in place at the corner. When the third wall is completed, another upper beam 122 is then readily available to sit directly on the lower step of the previous upper beam. The final upper beam 128 is put in place last after the fourth wall is completed. This beam has both of its ends upwardly stepped 130, 132 so that it can form a final lock onto both of the adjacent upper beams that are already in place.

With this particular construction of the upper beams, the walls can be continuously built in a counter clockwise direction with all members put in place, and once a member is put in place it does not have to be lifted any more to connect another member. Furthermore, a member is not finally connected and assembled until all of the parts being interconnected to it are fully in place. Nevertheless, because of the specific construction described, the parts will be held in place as you move along constructing subsequent parts. There is no need to have a separate individual hold parts in place but they are self retaining as you continue forming the construction in a counter clockwise manner around the periphery of the structure.

The door 24 can be inserted in place of the panels in the last wall to be erected. As shown in FIG. 1, the door can include a central panel section 160 formed within a peripheral frame 162 connected by means of the hinges 164 and operated by means of the knob 166. For convenience, the channel formed in the low base beam need not be provided where the door is to be placed. The hinges 164 can be hidden hinges.

In order to support the twigs and branches 28, additional tie beams 26 can be included, as shown in FIG. 1. Each of the tie beams 26 includes axially projecting bolts 170, 172 at either end thereof. The bolts can be inserted in appropriately provided apertures 174 in the upper beams, as shown in the top of FIG. 7. These bolts can be secured by means of the nuts 176, as shown in FIG. 1.

By placing the tie beams between the first assembled wall and the third assembled wall, and specifically prior to the completion of the last wall, the upper ends of the first and third walls can be manually spread apart in order to insert the tie beams and secure them in place. After this, the fourth and final wall can be built and secured in place.

As is shown in FIGS. 5 and 6, and other of the figures, the grooves 90, 92 and 94 which are formed in the various parts, as well as the groove 154 formed in the upper beam shown in FIG. 10, are all placed off center. In the example shown, they are all placed close to the exterior of the structure rather than to the interior. However, they could likewise all have been placed closer to the interior. By placing them offset, it is easy to align the various beams and studs since all of the grooves should lie along a common plane to receive the wall panels.

Although the specific structure has been shown to form a "succah" it should be understood that a similar an overlap joint of stepped ends at each base corner with the notches merging to form an undercut corner;

(b) placing an upright stud at one corner, the stud having opposing axially extending pins and the overlap joint having an aligned aperture whereby the pin is inserted into an aligned aperture to depend therefrom;

(c) assembling together the stud and a pair of adjacent base beams by attaching a clamping device onto the depending pin in the undercut corner without having to lift the base frame;

(d) coupling a wall panel to the assembled stud and one of the base beams;

(e) placing an upright stud at the opposing end of the wall panel and assembling it to the corner joint in a manner similar to the first corner joint;

(f) placing a roof beam onto the wall panel to complete a first wall, the roof beam having its opposing ends stepped with an aperture formed in each step, each aperture receiving an upwardly extending pin from the studs at each corner; and (g) proceeding around the periphery of the frame to form the other three walls, with the roof beam of a subsequent wall being interconnected to a roof beam of a previous wall by forming an overlap joint of the ends at each corner and assembling by attaching a clamping device onto the pin projecting from the apertures in the joint at the upper corner.

18. A method as in claim 17, and further comprising placing additional studs along the length of each base beam, at the location of an undercut notch along the base beam, the beam having an aperture therethrough for receiving a depending pin on the stud, assembling the stud by connecting a clamping device onto the depending pin in the undercut notch and wherein the upper beam includes apertures for receiving the projecting pin from the studs, which can be secured by a clamping device.

19. A method as in claim 17, wherein the base beam, the roof beams and the studs have inwardly facing channels, and comprising the step of sliding a wall panel into said channels.

20. A method as in claim 17, wherein the roof beam on said first wall is downwardly stepped at both its ends, the roof beam on the last wall is upwardly stepped at both its ends, and the roof beam on all other walls have opposing steps at their ends.

21. A method as in claim 17, and further comprising securing a plurality of tie beams across an opposing pair of roof beams, each tie beam having axially projecting pins at opposing ends thereof, the roof beams having spaced apertures for receiving the projecting pins, and securing the tie beams with clamping devices.

* * * * *